US006971201B2

(12) United States Patent
Brinkman et al.

(10) Patent No.: US 6,971,201 B2
(45) Date of Patent: Dec. 6, 2005

(54) CURVED BACK LABEL HOLDER FOR A SHELF

(75) Inventors: Michael Brinkman, Belvidere, IL (US); Craig Zadak, Roscoe, IL (US); Kirk Lewis, Lee's Summit, MO (US)

(73) Assignee: Southern Imperial, Inc., Rockford, IL (US)

( * ) Notice: Subject to any disclaimer, the term of this patent is extended or adjusted under 35 U.S.C. 154(b) by 0 days.

(21) Appl. No.: 10/458,291

(22) Filed: Jun. 10, 2003

(65) Prior Publication Data

US 2004/0250459 A1 Dec. 16, 2004

(51) Int. Cl.[7] ..... G09F 3/18
(52) U.S. Cl. ..... 40/642.02; 40/651; 248/231.81
(58) Field of Search ..... 40/642.02, 649, 40/651, 658, 661, 661.03; 248/231.81, 220.22; 211/57.1, 59.1

(56) References Cited

U.S. PATENT DOCUMENTS

| | | | | |
|---|---|---|---|---|
| D189,147 | S | 11/1960 | Hinchcliffe | |
| 3,164,354 | A | 1/1965 | Mordock | |
| 3,168,954 | A | 2/1965 | Herrmann | |
| D209,071 | S | 10/1967 | Koch | |
| D291,097 | S | 7/1987 | Dalbey et al. | |
| 5,044,104 | A * | 9/1991 | Hopperdietzel | 40/654.01 |
| 5,419,066 | A * | 5/1995 | Harnois et al. | 40/661.03 |
| 5,899,011 | A * | 5/1999 | Brinkman | 40/661.03 |
| 6,105,295 | A | 8/2000 | Brinkman et al. | |
| 6,226,910 | B1 * | 5/2001 | Ireland | 40/661.03 |
| D443,311 | S | 6/2001 | Wildrick | |
| 6,263,603 | B1 * | 7/2001 | Wildrick | 40/661 |
| D453,535 | S | 2/2002 | Wingerei et al. | |
| D454,163 | S | 3/2002 | Nagel | |
| 6,357,154 | B1 * | 3/2002 | Pfendler et al. | 40/661.03 |
| 6,470,613 | B1 | 10/2002 | Wildrick | |
| 6,688,567 | B2 * | 2/2004 | Fast et al. | 248/220.41 |

* cited by examiner

*Primary Examiner*—Brian K. Green
(74) *Attorney, Agent, or Firm*—Reinhart Boerner Van Deuren P.C.

(57) ABSTRACT

A label holder includes a front panel, a back panel connected to the front panel with a common bottom edge, the front panel and the back panel forming a cavity. The back panel is constructed to have a resilient rearward curvature that flexes to flatten against the shelf. The label holder further includes a retainer structure extending rearwardly from the back panel. The retainer structure includes a spring clip configured to resiliently clamp the label holder to the shelf. When mounted to the shelf, the shelf in combination with the retainer structure causes the flexure of the resilient rearward curvature to provide secure attachment of the label holder to the shelf.

9 Claims, 2 Drawing Sheets

CURVED BACK LABEL HOLDER FOR A SHELF

FIELD OF THE INVENTION

This invention pertains to the field of label holders for merchandise displays, and in particular, to label holders for mounting onto a shelf.

BACKGROUND OF THE INVENTION

The present invention is related to label holders that can be made from extruded plastic with a clear front panel that forms in combination with a main panel and a common bottom edge a cavity for retaining paper labels therebetween. Typically, such label holders are installed along the front edge of a display shelf. Conventional label holders are typically attached to the bottom edge of a display shelf via a full crown ridge integrally attached to the shelf, and generally project below the bottom edge of a shelf and are susceptible to removal if a product snags the label holder because the label holder is too loosely attached to the shelf.

BRIEF SUMMARY OF THE INVENTION

In light of the above, it is a general aim of the present invention to provide a label holder that resiliently clamps to a shelf such that the label holder is not susceptible to removal. In an embodiment, the label holder includes a front panel, a back panel connected to the front panel with a common bottom edge, said front panel and the back panel forming a cavity for labels to be inserted therein. The back panel is constructed to have a resilient rearward curvature that flexes to flatten against the shelf.

The label holder further includes a retainer structure extending rearwardly from the back panel. The retainer structure includes a spring clip configured to resiliently clamp the label holder to the shelf. The label holder is configured such that when mounted to the shelf, the shelf in combination with said retainer structure causes the flexure of said resilient rearward curvature to provide secure attachment of said label holder to the shelf.

The spring clip provides resilient clamping onto the shelf such that the spring clip causes the back panel to resiliently flex against the shelf and the spring clip clamps the shelf between the spring clip and the back panel. Spring clip also clamps the shelf between a bottom surface of the label holder and the spring clip.

The label holder can also be configured to include a flange that projects forwardly from the common bottom edge and bends upwardly towards the front panel. In an embodiment, the label holder also includes a protective flange configured to extend forwardly over the front panel.

In one embodiment, the front panel and the back panel are configured to have approximately a 1° separation prior to attachment to the shelf, the separation narrowing at an upper portion such that the front panel meets or nearly meets the back panel.

One embodiment is directed to a label holder mounted on a shelf. The shelf has a top surface, a flat angled panel and a lower support flange and the label holder. In the embodiment, the label holder includes a retainer structure that extends rearwardly from a back panel. The retainer structure includes a spring clip configured to resiliently clamp the label holder to the shelf. The retainer structure and the back panel resiliently flex to the shelf, the mounting to the shelf causing the resilient rearward curvature to flatten and grip the flat angled panel.

Other objectives and advantages of the invention will become more apparent from the following detailed description when taken in conjunction with the accompanying drawing.

BRIEF DESCRIPTION OF THE DRAWINGS

The accompanying drawings incorporated in and forming a part of the specification illustrate several aspects of the present invention, and together with the description serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 2:
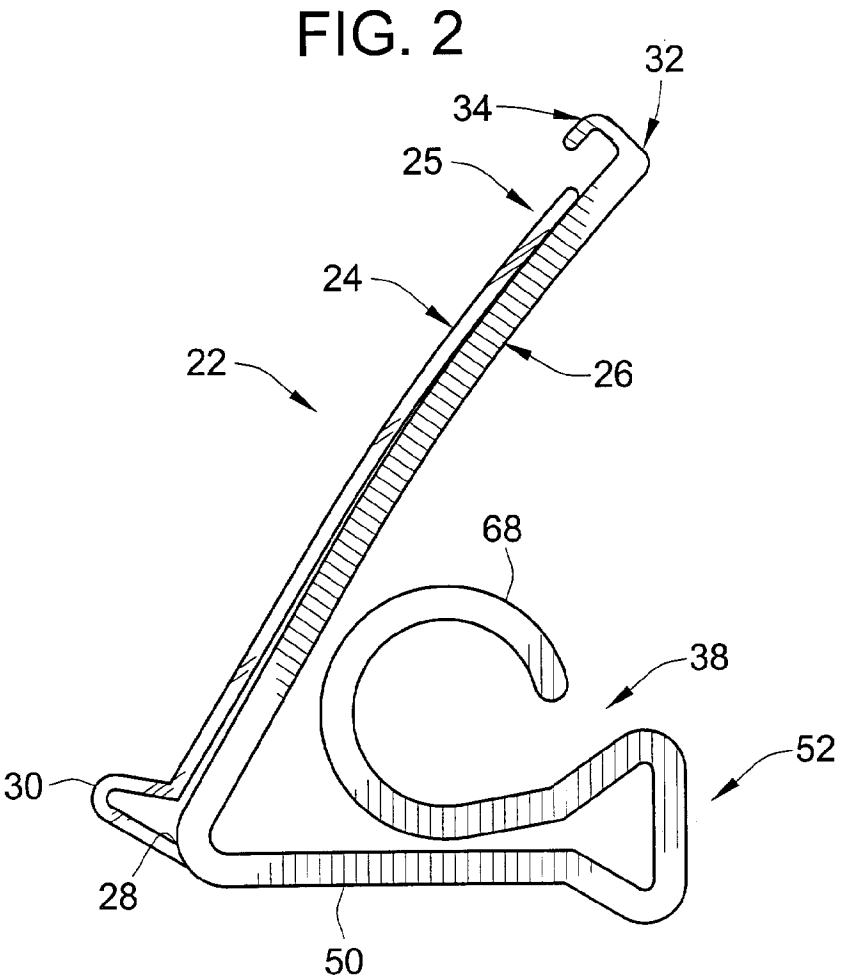
FIG. 2 is a side view of a label holder outside of the shelf structure illustrating features in accordance with an embodiment of the present invention.
Figure 1:
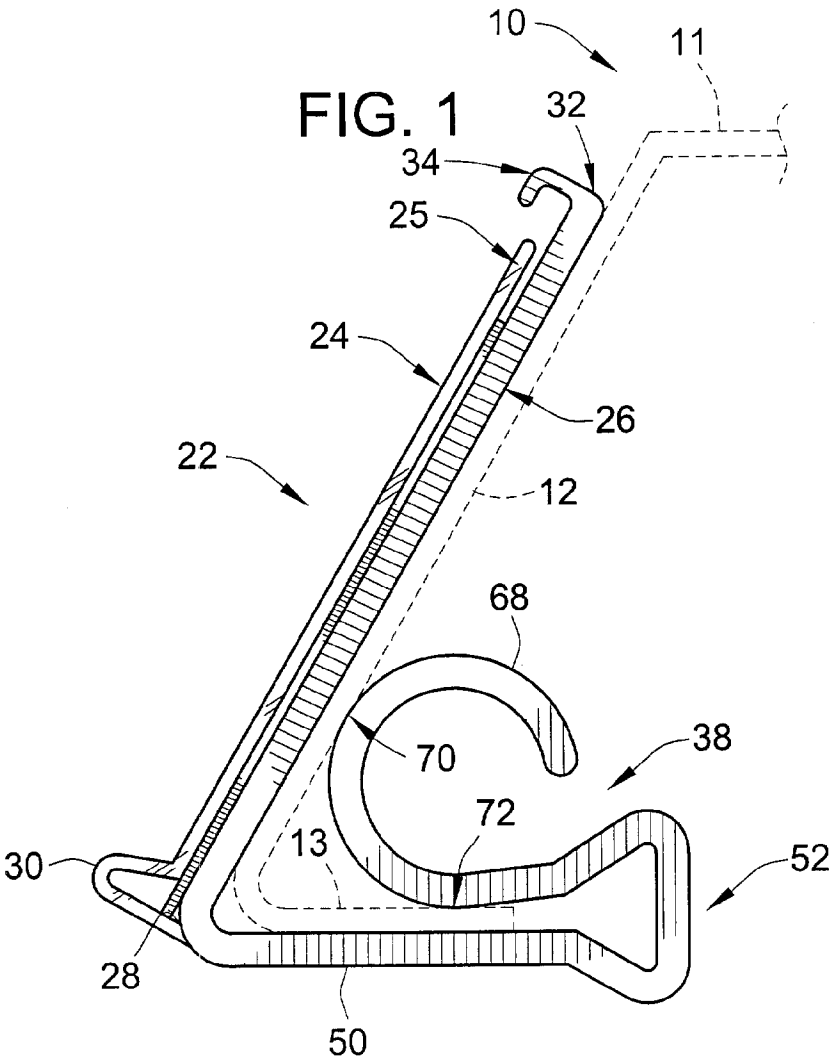
FIG. 1 is side view of a label holder installed in a shelf structure shown in dashed lines in accordance with an embodiment of the present invention.

Referring now to the figures, FIG. 1 illustrates a shelf structure 10 having a top surface 11 and a flat angled front panel 12 and a lower support flange 13. Typically, shelf structure 10 is constructed of a metal and of a flat faced type such as that referred to as Darling or Syndicate type flat-faced shelving. Flat top surface 11 can be structured to hold products such as would be appropriate for retail display.

Also shown in FIG. 1 is a label holder, generally designated by the reference number 22. Label holder 22 can be extruded of a plastic material, such as polyvinyl chloride, Butryrate, Provista or acrylonitrile butadiene styrene (ABS), and can be either translucent or partially translucent, for example, as in having a co-extruded opaque back portion. In another embodiment, the label holder can be opaque or partially opaque. The opacity determines whether the label holder is appropriate for using adhesive and non-adhesive labels. A translucent front enables non-adhesive labels, however, an opaque label holder can be used with adhesive labels. The label holder 22 includes a front panel 24 and a back panel 26 that are joined along a common bottom edge 28. Label holder 22 further includes a flange 30 projecting forwardly from common bottom edge 28 and bending upward to the front panel 24 to facilitate a scanning wand or the like for scanning labels inserted into label holder 22. The back panel 26 extends upwardly and bends forwardly to form a top portion 32 forming a protective flange 34 that extends forwardly over front panel 24 back portion 26 bottom portion.

Label holder 22 further includes a flat bottom surface 50 extending rearwardly from the back panel 26. Flat bottom surface 50 is part of retainer structure 38. Retainer structure 38 also includes a forwardly-facing, spring clip 68 connected to a rearward end 52 with an opening at an end of spring clip 68 that provides resilient clamping onto shelf 10 at two clamp points identified by reference numbers 70 and 72. The area between the back panel 26, bottom surface 50 and spring clip 68 forms gripping channel including clamp points 70 and 72.

The back panel in the first relaxed state defines a curved surface extending through a middle portion of the back panel between top and bottom portions of the back panel.

Front panel 24 also has a resilient curve. Back panel 26 and front panel 24 together each flex when installed onto shelf 10 to cause back panel 26 to be flush with angled front panel 12 of shelf 10. The amount by which the back panel 26 and front panel 24 form a resilient rearward curvature depends on design requirements. Depending on the type of plastic used for the label holder, and the flexure thereof, a curvature can be greater or less than the curvature shown and be within the scope of the present disclosure. In one embodiment, the curvature and flexure is enough to form a seal when installed with angled front panel 12.

Front panel 24 can be configured to nearly match the curve of back panel 26 such that flange 30 of front panel 26 extends outwardly by about a 1° separation between back panel 26 and front panel 24. The separation gradually narrows such that an upper portion 25 of front panel 24 meets or nearly meets back panel 26 when not installed. Thus, even though back panel 26 arcs away from front panel 24, front panel 24 grips back panel 26 at upper portion 25 when not mounted to shelf 10. Between front panel 24 and back panel 26 a cavity suitable for receiving labels is formed with the bottom portion 28 of the cavity being wider than the top portion of the cavity when not mounted to shelf 10. Referring back to FIG. 1, after mounting to shelf 10, as shown back panel 26 grips the surface of angled front panel 12 and angled front panel 24 lies approximately parallel to back panel 26 at top area 25 when installed.

Figure 3:
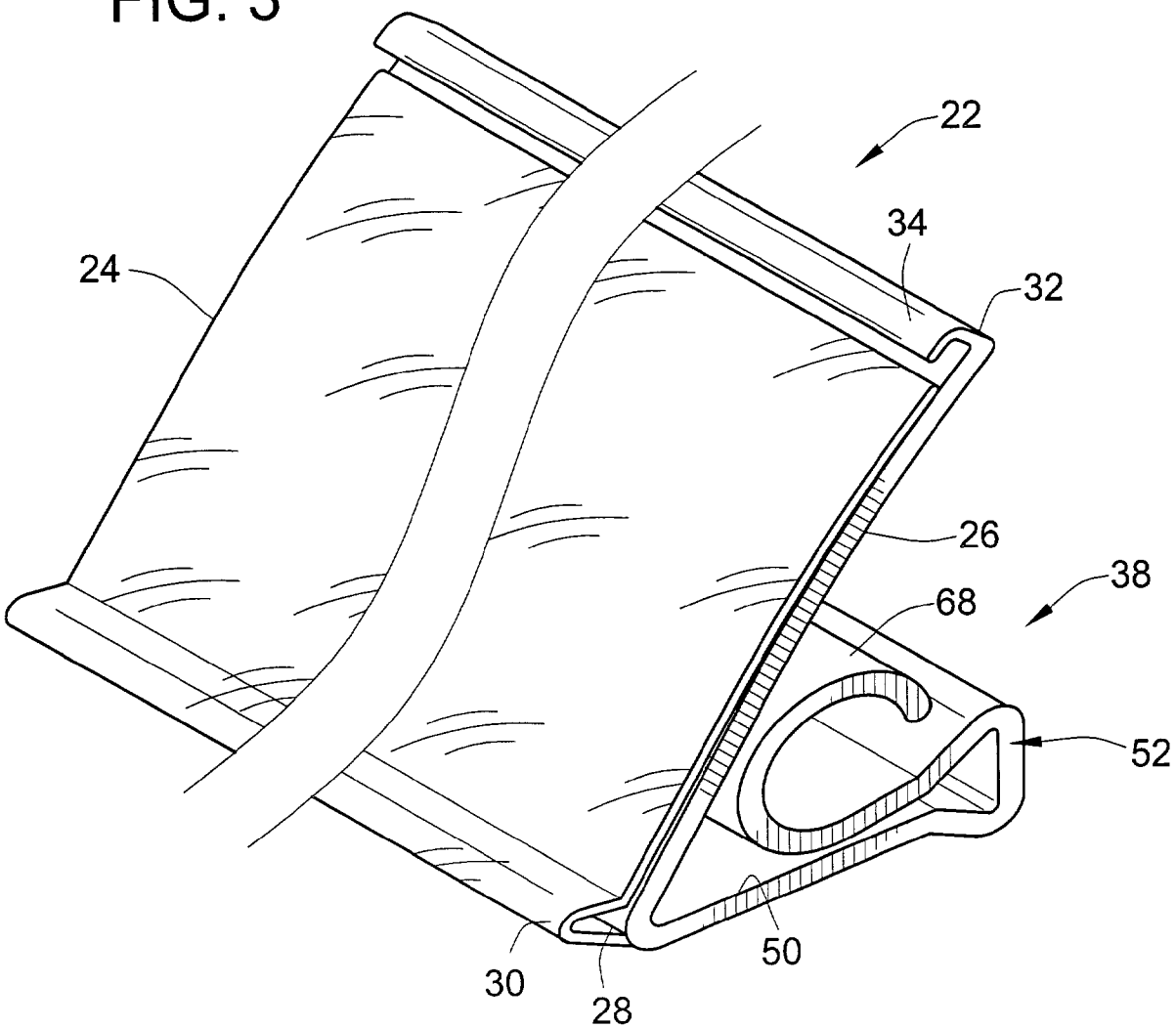
FIG. 3 is a perspective view of the label holder in accordance with an embodiment of the present invention.

Referring now to FIG. 3, a perspective broken view of label holder 22 is shown illustrating that label holder 22 can be of any suitable length appropriate for any length shelf 10. As one skilled in the art will appreciate, the size of label holder 22 can be adjusted for different sized shelves 10. In a typical embodiment, top 32 of label holder 22 does not project above the top of shelf 10 thereby enabling customers to easily remove products from a display above label holder 22. Also, the height of label holder 22 can be adjusted for different sized angled front panels 12. Typically, however, the height of label holder 22, at least in some embodiments, can be approximately between 1" and 1½" or approximately between 3 and 4 inches.

The label holder in embodiments herein, represents a significant improvement over known label holders in that now a reliable label holder can be attached to three-sided shelves such as shelf 10 in a secure manner. Referring now to FIG. 1, to mount label holder 22 onto shelf 10, spring clip 68 and back panel 26 resiliently flex around shelf 10 at lower support flange 13. Retainer structure 38, with spring clip 68, and rearward end 52, can function as a spring to provide resilient attachment to shelf 10. After attaching label holder 22 to shelf 10, label holder 22 grips angled panel 12 and lower support flange 13 by having spring clip 68 grip both the angled front panel 12 and lower support flange 13 at the same time. When in the fully mounted position, back panel 26 lies flush with angle front panel 12; and flat bottom surface 50 lies flush with lower support flange 13. During mounting, retainer structure 38, including spring clip 68, bottom surface 50 and rearward end 52 resiliently expand around lower support flange 13 of shelf structure 10. Specifically, one method of attaching label holder 22 includes flexing retainer structure 38 around lower flange 13 of shelf structure 10, and allowing spring clip 68 to then contact angled panel 12 of shelf structure 10 from the rear thereof, while back panel 26 also meets the forward face of angled panel 12. As back panel 26 flexes to meet shelf structure 10, the curvature of back panel 26 flattens against the shelf as retainer structure 38, and more particularly, spring clip 68 grips the shelf.

All of the references cited herein, including patents, patent applications, and publications, are hereby incorporated in their entireties by reference.

The foregoing description of various embodiments of the invention has been presented for purposes of illustration and description. It is not intended to be exhaustive or to limit the invention to the precise embodiments disclosed. Numerous modifications or variations are possible in light of the above teachings. The embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A retail display apparatus comprising in combination:

(a) a shelf comprising:

a top panel extending horizontally;

a front angled panel having a flat front surface extending downwardly and forwardly from the top panel; and a lower support flange extending horizontally rearwardly from the front angled panel in vertical spaced relation to the top panel;

(b) a label holder being formed of resilient plastic material, the label holder comprising:

a front panel;

a back panel connected to the front panel via an integral hinge, said front panel pivoting relative to the front panel through the integral hinge to form a pocket therebetween for receiving a label;

a retainer structure integrally connected to the front and back panels, the retainer including a bottom flange extending rearwardly relative to the back panel, the bottom flange carrying a clip;

wherein the label holder has a first relaxed state when the label holder is not mounted to the shelf;

wherein the label holder has a second biased state when the label holder is mounted to the shelf, in which the bottom flange extends underneath the lower support flange and the clip engages at least one of the lower support flange and the front angled panel at a location behind the front angled panel, and wherein the back panel is deformed from the relaxed state into a flexed state in which the back panel is providing a biasing force engaging the flat front surface to clamp in cooperation with the clip to secure the label holder to the shelf; and wherein the back panel in the first relaxed state defines a curved surface extending through a middle portion of the back panel between top and bottom portions of the back panel.

2. The retail display apparatus of claim 1, wherein the back panel is substantially flattened in the second biased state, wherein the curved surface has been substantially straightened from the first relaxed state to the second biased state.

3. The retail display apparatus of claim 1, wherein a rear side of the back panel is in substantially complete planar surface to surface contact with the flat front surface in the second biased state.

4. The retail display apparatus of claim 1, wherein the label holder is independent of and free of any mounted support by the top panel.

5. The retail display apparatus of claim 4, wherein the label holder is completely free of contact with the top panel.

6. The retail display apparatus of claim 1, wherein the bottom flange engages a bottom side of the lower support flange, and wherein the clip engages a back side of the front angled panel and a top side of the lower support flange.

7. The retail display apparatus of claim 1, wherein the clip is connected to the bottom flange through a vertically extending pivot hinge, a vertical gap between the clip and the bottom flange that is less than a vertical thickness of the lower support flange when in the relaxed state.

8. The retail display apparatus of claim 7, wherein the label holder defines a void space generally at the pivot hinge between the clip and the bottom flange, the void space being substantially greater in a vertical dimension as compared to the vertical gap.

9. The retail display apparatus of claim 8, wherein the pivot hinge comprises first and second corners in spaced relation.

* * * * *